US009383071B2

(12) United States Patent
Kim

(10) Patent No.: US 9,383,071 B2
(45) Date of Patent: Jul. 5, 2016

(54) LED LIGHTING APPARATUS HAVING AN ADJUSTABLE LIGHT DISTRIBUTION

(71) Applicant: KMW INC., Hwaseong, Gyeonggi-Do (KR)

(72) Inventor: Duk-Yong Kim, Gyeonggi-Do (KR)

(73) Assignee: KMW INC., Hwaseong, Gyeonggi-do (KR)

( * ) Notice: Subject to any disclaimer, the term of this patent is extended or adjusted under 35 U.S.C. 154(b) by 241 days.

(21) Appl. No.: 14/084,838

(22) Filed: Nov. 20, 2013

(65) Prior Publication Data

US 2014/0111987 A1 Apr. 24, 2014

Related U.S. Application Data

(63) Continuation of application No. PCT/KR2012/003280, filed on Apr. 27, 2012.

(30) Foreign Application Priority Data

May 20, 2011 (KR) ..... 10-2011-0047682
Sep. 27, 2011 (KR) ..... 10-2011-0097486

(51) Int. Cl.
*F21V 29/75* (2015.01)
*F21K 99/00* (2016.01)
(Continued)

(52) U.S. Cl.
CPC ..... *F21K 9/58* (2013.01); *F21V 7/0008* (2013.01); *F21V 29/004* (2013.01); *F21V 29/75* (2015.01);
(Continued)

(58) Field of Classification Search
CPC ..... F21V 7/0008; F21V 29/763; F21V 29/75; F21V 29/004; F21V 19/00; F21V 19/001; F21V 19/003; F21V 29/22; F21V 29/503; F21V 29/74; F21W 2131/103; F21Y 2101/02; F21Y 2105/001; F21K 9/58; H01L 33/64
See application file for complete search history.

(56) References Cited

U.S. PATENT DOCUMENTS 7,654,702 B1 * 2/2010 Ding ..... F21V 29/004 362/218
8,287,152 B2 * 10/2012 Gill ..... F21S 2/005 362/249.02
(Continued)

FOREIGN PATENT DOCUMENTS

CN 1762061 A 4/2006
DE 102006037376 A1 2/2008
(Continued)

OTHER PUBLICATIONS

Canadian Intellectual Property Office Examination Report for Canadian Application No. 2,836,869, dated Dec. 15, 2014, 5 pages.
(Continued)

*Primary Examiner* — Bao Q Truong
(74) *Attorney, Agent, or Firm* — Mintz Levin Cohn Ferris Glovsky and Popeo, P.C.; Kongsik Kim; Colleen H. Witherell

(57) ABSTRACT

An LED lighting apparatus having adjustable light distribution comprises: a support panel on which a plurality of heat dissipation fins are disposed on a back surface thereof, the support panel providing a parallel front part which is not parallel to the ground; a board on which a plurality of LEDs are mounted, and being coupled to said front part of the support panel; and a reflection part fixed to the support panel so as to be disposed on the front surface of said substrate, and reflecting light emitted from said plurality of LEDs to provide a curved reflection surface which forms light distribution patterns on the ground. The light emission surface of the LED is not disposed parallel to the ground. The light emitted from the LED is distributed through the reflection part having a curved surface reflecting the light emitted from the LED toward the ground.

22 Claims, 8 Drawing Sheets

(51) Int. Cl.

| | |
|---|---|
| ***F21V 7/00*** | (2006.01) |
| ***F21V 29/00*** | (2015.01) |
| ***F21V 29/76*** | (2015.01) |
| *F21W 131/103* | (2006.01) |
| *F21Y 101/02* | (2006.01) |
| *F21Y 105/00* | (2016.01) |

(52) U.S. Cl.
CPC ..... *F21V 29/763* (2015.01); *F21W 2131/103* (2013.01); *F21Y 2101/02* (2013.01); *F21Y 2105/001* (2013.01)

(56) References Cited

U.S. PATENT DOCUMENTS

| | | | | |
|---|---|---|---|---|
| 2009/0243455 | A1 | 10/2009 | Biebel et al. | |
| 2010/0079983 | A1* | 4/2010 | Kumamoto | F21S 8/02 362/147 |
| 2010/0284181 | A1* | 11/2010 | O'Brien | F21S 8/026 362/235 |
| 2011/0026253 | A1 | 2/2011 | Gill | |

FOREIGN PATENT DOCUMENTS

| | | | |
|---|---|---|---|
| DE | 102007030186 | A1 | 1/2009 |
| EP | 2071227 | A1 | 6/2009 |
| JP | 8-273410 | | 10/1996 |
| JP | 2002-270008 | A | 9/2002 |
| JP | 2005-283817 | A | 10/2005 |
| JP | 2007-300138 | A | 11/2007 |
| JP | 2011-515816 | A | 5/2011 |
| KR | 10-2006-0036039 | A | 4/2006 |
| KR | 10-2009-0050394 | A | 5/2009 |
| KR | 10-1023826 | B1 | 3/2011 |
| WO | 2005/055328 | A1 | 6/2005 |
| WO | WO-2008098360 | A1 | 8/2008 |
| WO | WO-2009000536 | A1 | 12/2008 |
| WO | WO-2010024507 | A1 | 3/2010 |

OTHER PUBLICATIONS

Examination report dated Aug. 11, 2014 issued in connection with Japanese Application No. 2014-511280.

* cited by examiner

LED LIGHTING APPARATUS HAVING AN ADJUSTABLE LIGHT DISTRIBUTION

CROSS-REFERENCE TO RELATED APPLICATIONS

This application is a continuation application of International Application No. PCT/KR2012/003280 filed on Apr. 27, 2012, which claims priority to Korean Application No. 10-2011-0047682 filed on May 20, 2011 and Korean Application No. 10-2011-0097486 filed on Sep. 27, 2011, which applications are incorporated herein by reference.

TECHNICAL FIELD

The present disclosure relates to an LED lighting apparatus capable of adjusting light distribution, and more particularly, to an LED lighting apparatus capable of adjusting light distribution in which LEDs are disposed vertically and a light distribution pattern thereof can be adjusted according to the position.

BACKGROUND ART

In general, in a lighting apparatus using an LED, such as a street light, a decoration light, and a security light, a substrate thereof to which the LED is mounted is disposed in parallel with the ground. Of course, although a structure in which an installation angle thereof is slightly varied in the front-rear direction and in the right-left direction to adjust an irradiation angle thereof has been proposed, a configuration in which a light emission surface of the LED is arranged in a direction perpendicular to the ground or in a direction almost perpendicular to the ground is hardly found.

In this way, in the lighting apparatus using an LED according to the related art, since the light emission surface of the LED faces the ground, it is difficult to adjust a light distribution pattern of the LED. Accordingly, a structure of a housing for supporting a substrate to which a plurality of LEDs are mounted is changed to change an orientation angle of each of LED groups so as to make the light distribution pattern of the whole lighting apparatus into a desired shape.

Accordingly, in the lighting apparatus using an LED according to the related art, different housings should be made according to use of the lighting apparatus, and there is a problem in that it is impossible or very difficult to adjust the light distribution thereof.

In addition, since heat dissipation fins at an opposite side of the light emission surface of the LED according to the related art are disposed in parallel with the ground, air therein does not perform convection so that a heat dissipation effect is low and a lifespan of the LED is shortened.

For example, Korean Patent Laid-Open Publication No. 2003-0044324 discloses a tunnel lamp using an LED, and more particularly, a tunnel lamp of which an LED substrate is installed in parallel with the road and a housing curved in an L-shaped form is employed, so as to prevent a glare directed toward a driver.

However, since spotlights using an LED according to the related art, including Korean Patent Laid-Open Publication No. 2003-0044324, are installed in parallel with the road surface such that a light emission surface of the LED faces the road surface, the spotlights have a light distribution pattern that meets an inherent light irradiation angle of the LED.

Although there is a difference between light distribution patterns of a general street light and a tunnel lamp, it is difficult to arbitrarily form a light distribution pattern, and a lens for converting the light distribution patterns into a specific light distribution pattern is employed in order to solve the above-mentioned problems.

The lens corresponds to a factor of a LED light which increases a cost, and causes optical loss so as to decrease intensity of illumination. When the lens is employed, since the intensity of illumination to be provided to the road surface decreases, more LEDs should be used to adjust the intensity of illumination of the road surface, which causes an increase in manufacturing costs and an increase in power consumption so as to deteriorate advantages of the LED light.

SUMMARY

The present disclosure has been made in view of the above-mentioned problems, and it is an aspect of the present disclosure to provide an LED lighting apparatus capable of adjusting light distribution which can commonly use one housing structure regardless of use of an LED lighting apparatus such as a street light, a decoration light, and a security light.

Further, it is another aspect of the present disclosure to provide an LED lighting apparatus capable of adjusting light distribution which can easily adjust and change light distribution patterns.

Furthermore, it is another aspect of the present disclosure to provide an LED lighting apparatus capable of adjusting light distribution which has an excellent heat dissipation characteristic.

In accordance with an aspect of the present disclosure, there is provided an LED lighting apparatus capable of adjusting light distribution including a support panel that has a plurality of heat dissipation fins on a rear surface thereof and provides a support surface; a substrate coupled to the support surface of the support panel, a plurality of LEDs being mounted to the substrate; and a reflection surface fixed to the support panel to be located on a front surface of the substrate, that forms a light distribution pattern on the ground by reflecting light emitted from the plurality of LEDs.

An LED lighting apparatus capable of adjusting light distribution according to an embodiment of the present disclosure is configured such that a light emission surface of an LED is not disposed in parallel with the ground and light distribution is performed through a curved reflection portion for reflecting emission light of the LED to the ground, to form various light distribution patterns according to a shape of the curved reflection portion, disposition of the LEDs, an angle between a light emission surface of the LEDs and the ground, or existence of a plane reflection portion for re-reflecting light reflected from the curved reflection portion, so as to be applied to various lighting application fields while using the same structure.

Further, an LED lighting apparatus capable of adjusting light distribution according to an embodiment of the present disclosure is configured such that a light emission surface of an LED is not disposed in parallel with the ground and heat dissipation fins for dissipating heat generated in the LED is not disposed in parallel with the ground, to naturally perform convection of air to improve a heat dissipation characteristic, so as to increase a lifespan of the LED lighting apparatus.

DETAILED DESCRIPTION

Hereinafter, an LED lighting apparatus capable of adjusting light distribution according to embodiments of the present disclosure will be described in detail with reference to the accompanying drawings.

Figure 1:
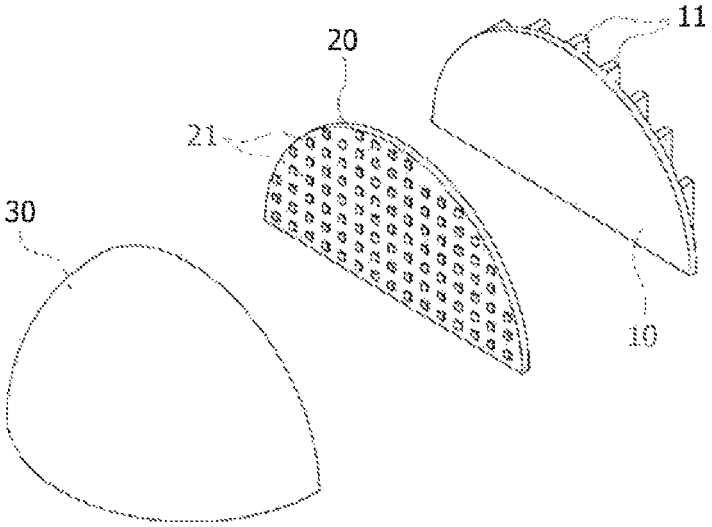
FIG. 1 is an exploded perspective view showing an LED lighting apparatus capable of adjusting light distribution according to an embodiment of the present disclosure.
Figure 2:
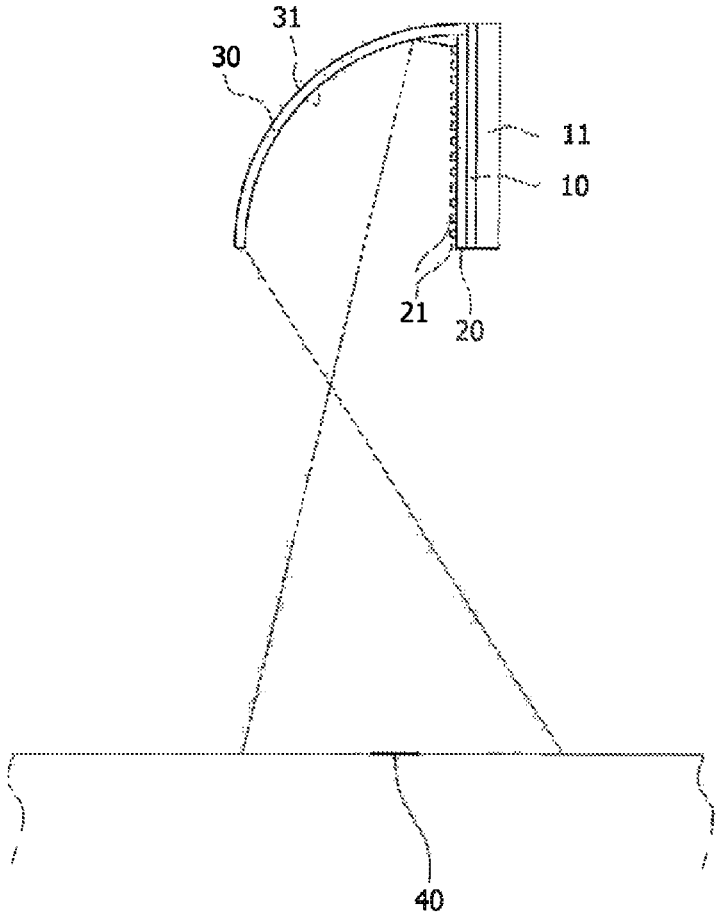
FIG. 2 is a sectional view showing a coupled state of FIG. 1.

FIG. 1 is an exploded perspective view showing an LED lighting apparatus capable of adjusting light distribution according to an embodiment of the present disclosure, and FIG. 2 is a sectional view showing a coupled state of the LED lighting apparatus of FIG. 1.

Referring to FIGS. 1 and 2, an LED lighting apparatus capable of adjusting light distribution according to an embodiment of the present disclosure includes a support panel 10, which is shaped like a semicircular disc and has a rear surface having vertically-elongated heat dissipation fins 11, a substrate 20 coupled to a front surface of the support panel 10, a plurality of LEDs 21 being mounted to the substrate 20, and a reflection portion 30 fixed to the support panel 10 and having a curved reflection surface 31 for reflecting light emitted from the LEDs 21 to form a light distribution pattern 40 on the ground.

Hereinafter, a configuration and an operation of the above-configured LED lighting apparatus capable of adjusting light distribution according to an embodiment of the present disclosure will be described in more detail.

First, the support panel 10, which is shaped like a semicircular disc, has a front surface having a flat semicircular shape, and a rear surface having a plurality of heat dissipation fins 11 which are provided in a vertically elongated form.

The support panel 10 is a metal which can easily conduct heat, and the substrate 20 is coupled and fixed to a support surface of the support panel 10.

The substrate 20 has a shape of a semicircular disc. The substrate 20 has a front surface having the plurality of LEDs 21. Although not shown in drawings, a hole for connection of an electric wire may be provided in the support panel 10, and electric power may be supplied to the substrate 20.

A tip end of the reflection portion 30 is coupled to a peripheral area of the support surface of the support panel 10. This coupling may be performed by coupling means such as bonding or inserting.

The reflection portion 30 corresponds to a spherical body having a shape obtained by dividing a sphere vertically and horizontally, and has the curved reflection surface 31 formed at an inner side thereof.

The reflection surface 31 serves to reflect light emitted from the LEDs 21 so as to irradiate the light through a space at a bottom surface thereof, and various light distribution patterns 40 may be realized according to a curvature of the reflection surface 31.

Further, an incidence angle at which light is illuminated to the reflection surface 31 of the reflection portion 30 is changed according to location of the LEDs 21, and different light distribution patterns 40 may be obtained according to the location of the LEDs 21.

That is, in the present disclosure, various light distribution patterns 40 may be made by an arrangement of the LEDs 21 on the substrate 20 and a curvature of the reflection surface 31 of the reflection portion 30.

Figure 3:
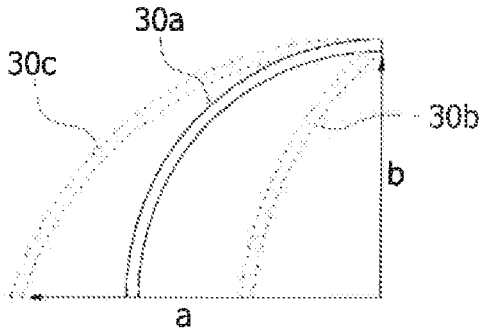
FIG. 3 is a schematic diagram for describing a reflection portion of FIG. 1 having various curvatures.

FIG. 3 is a schematic diagram for describing the reflection portion having various curvatures.

Referring to FIG. 3, a reflection portion 30*a* of which a radius a and a height b are equal to each other has a shape obtained by dividing a perfect spherical body with respect to a horizontal center and a vertical center, and a reflection portion 30*b* of which a radius a is smaller than a height b and a reflection portion 30*c* of which a radius a is larger than a height b may exist as examples obtained by dividing a spherical body, of which a cross section is an ellipse, with respect to a horizontal center and a vertical center.

Examples of the reflection portions 30*a*, 30*b*, and 30*c* show that various shaped spherical bodies divided twice, both vertically and horizontally may be applied to the present disclosure, and a common feature of the respective reflection portions 30*a*, 30*b*, and 30*c* is to provide a curved reflection surface 31 to reflect illuminated light in various forms so as to make arbitrary light distribution patterns 40.

All of the LEDs 21 are located above a bottom end of the reflection portions 30, 30*a*, 30*b*, and 30*c*. All light of the LEDs 21 is reflected through the reflection surface 31 and is then irradiated to the ground through a space at a bottom surface of the reflection portions 30, 30*a*, 30*b*, and 30*c*.

Figure 4:
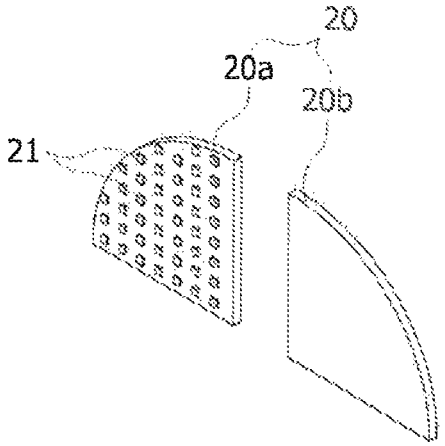
FIG. 4 illustrates a configuration of a substrate shown in FIGS. 1 and 2 according to another embodiment of the present disclosure.

FIG. 4 illustrates a configuration of a substrate shown in FIGS. 1 and 2 according to another embodiment of the present disclosure.

The substrate 20 may be vertically divided into a first substrate 20*a* and a second substrate 20*b* according to necessity, and the LEDs 21 may be selectively mounted on the first substrate 20*a* or the second substrate 20*b* according to necessity.

Such division of the substrate may change a shape of the light distribution pattern 40 according to disposition of the LEDs 21 as described above, and the LEDs 21 may be disposed on only the first substrate 20*a* or only the second substrate 20*b* according to a shape of the arbitrary light distribution pattern 40.

Although FIG. 4 illustrates and describes an example where the substrate 20 is divided into two substrates 20*a* and 20*b*, the substrate 20 may be divided a larger number of times, and a desired light distribution pattern 40 may be formed by adjusting existence of the LEDs 21 on each divided substrate and an arrangement shape of the LEDs 21 on each divided substrate.

Further, it will be naturally understood by those skilled in the art that the plurality of substrates divided as above may be installed to be inclined by a predetermined angle with respect to a front surface of the support panel 10 in order to obtain a desired light distribution pattern.

Figure 5:
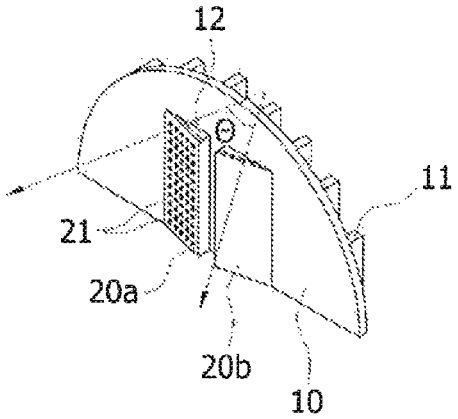
FIG. 5 illustrates a configuration of an installed state of a first substrate and a second substrate shown in FIG. 4 according to another embodiment of the present disclosure.

FIG. 5 illustrates a configuration of an installed state of a first substrate and a second substrate according to another embodiment of the present disclosure.

Referring to FIG. 5, inclined support portions 12 are provided on a front surface of the support panel 10 and the first substrate 20*a* and the second substrate 20*b* are coupled to the inclined support portions 12, respectively, so that irradiation directions of the LEDs 21 provided on the first substrate 20*a* and the second substrate 20*b* may be different from each other.

A light irradiation angle of the first substrate 20*a* and the second substrate 20*b* corresponds to an angle θ larger than 0° and smaller than 180°, and the angle θ may be adjusted according to the inclined support portions 12.

In this way, various shaped light distribution patterns may be arbitrarily made by adjusting an orientation angle of the divided substrates 20.

This is, the present disclosure may arbitrarily realize various light distribution patterns without changing a structure of the housing.

Figure 6:
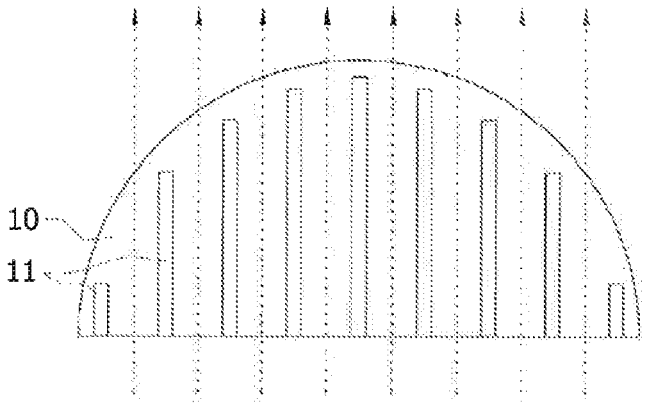
FIG. 6 illustrates a rear surface of a support panel shown in FIGS. 1 and 2 according to an embodiment of the present disclosure.

FIG. 6 illustrates a configuration of a rear surface of the support panel according to an embodiment of the present disclosure.

Referring to FIG. 6, heat dissipation fins 11 are provided on the rear surface of the support panel 10, and are disposed in a vertically elongated form. When heat generated in the LEDs 21 is transferred to the heat dissipation fins 11 and then the transferred heat is exchanged for heat of air adjacent to the heat dissipation fins 11, such a disposition causes natural convection of the air while the heat-exchanged air moves upward.

The convection of the air generates an upward air flow at valley portions between the heat dissipation fins 11, and makes air at a lower be side continuously introduced to the heat dissipation fins 11 side, thereby improving a heat dissipation characteristic.

A lifespan of the LEDs 21 is shortened by heat generated in the LEDs 21, as is well known, and the lifespan of the LEDs 21 can be prevented from being shortened by improving the heat dissipation characteristic as described above.

Figure 7:
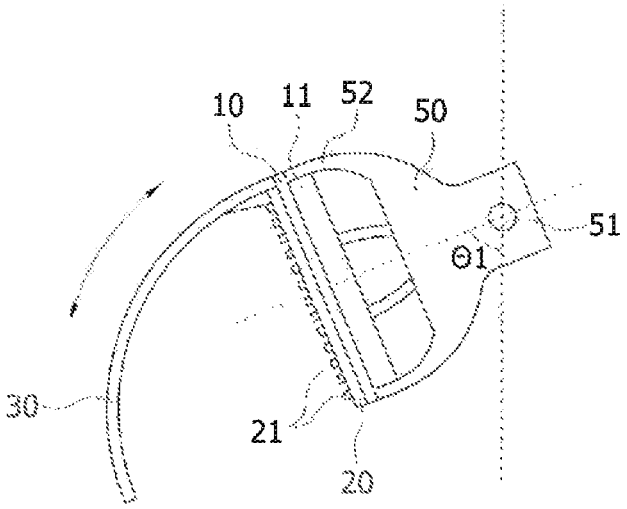
FIG. 7 illustrates a configuration of an LED lighting apparatus capable of adjusting light distribution according to another embodiment of the present disclosure.

FIG. 7 illustrates a configuration of an LED lighting apparatus capable of adjusting light distribution according to another embodiment of the present disclosure.

Referring to FIG. 7, the LED lighting apparatus capable of adjusting light distribution further includes a housing 50 for adjusting an up-down directional angle of an entirety of the configuration according to the embodiment of the present disclosure shown in FIGS. 1 and 2.

The housing 50 includes a hinge 51. A coupling protrusion 52 is located at one end of the housing 50 so that the housing 50 fixes the support panel 10 while not closely contacting the heat dissipation fins 11.

An interval between the support panel 10 and the housing 50 is formed so that a heat dissipation effect is prevented from being deteriorated due to blocking of the convection of air.

Further, an angle of a coupled body formed by the support panel 10, the substrate 20, and the reflection portion 30 can be adjusted by using the hinge 51 of the housing 50, and various light distribution patterns can be realized by the angle adjustment.

At this time, the angle adjustment using the hinge 51 may be performed within a range of an adjustment angle θ1 with respect to a base line perpendicular to the ground, and the adjustment angle θ1 may be 30° to 120°. When the adjustment angle θ1 is smaller than 30°, the light emission surface of the LEDs 21 is almost parallel to the ground. When the adjustment angle θ1 is larger than 120°, the light emission surface of the LEDs 21 faces the sky so that it is difficult to specifically make the light distribution pattern 40 made by light reflected from the reflection portion 30 and to obtain minimal illumination required for a light.

Figure 8:
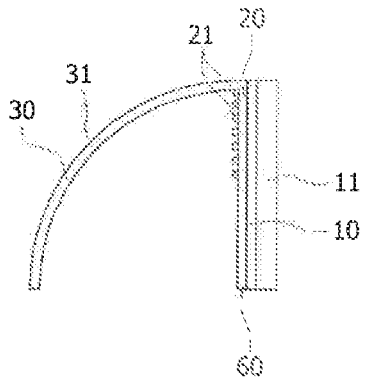
FIG. 8 illustrates a sectional configuration of an LED lighting apparatus capable of adjusting light distribution according to another embodiment of the present disclosure.

FIG. 8 illustrates a sectional configuration of an LED lighting apparatus capable of adjusting light distribution according to another embodiment of the present disclosure.

Referring to FIG. 8, the support panel 10 has a shape of a circular disc, the substrate 20 has a shape of a semicircular disc, and the plane reflection plate 60 is located at a lower side of a portion where the support panel 10 and the substrate 20 are coupled.

The plane reflection plate 60 serves to re-reflect light of the LEDs 21 reflected from the reflection surface of the reflection portion 30 so as to form the light distribution pattern 40. The reflection plate 60 partially blocks the light of LEDs 21 from being irradiated toward a rear side with respect to the reflection plate 60, and a shape of the light distribution pattern 40 is changed according to existence of the reflection plate 60.

In this way, the present disclosure can change the light distribution pattern 40, which corresponds to a pattern of light irradiated to the ground, according to existence of the reflection plate 60 so as to realize an LED lighting apparatus having various light distribution patterns 40.

Figure 9:
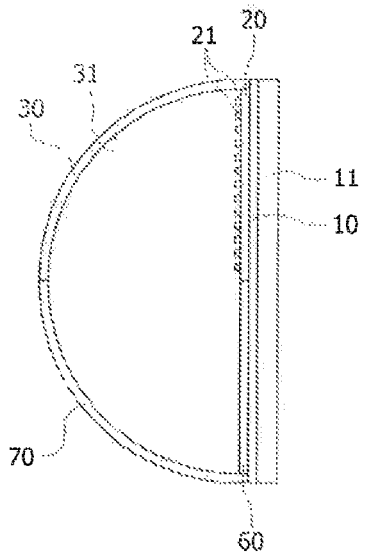
FIGS. 9 and 10 illustrate configurations of an LED lighting apparatus capable of adjusting light distribution according to respective other embodiments of the present disclosure.

FIG. 9 illustrates a configuration of an LED lighting apparatus capable of adjusting light distribution according to another embodiment of the present disclosure;

Referring to FIG. 9, the LED lighting apparatus including the reflection plate 60 as shown in FIG. 8 further includes a spherical light penetration cover 70 at a lower side of the reflection portion 30.

The light penetration cover 70 penetrates light of LEDs 21 reflected from the reflection portion 30 and the reflection plate 60 without including a reflection surface and serves to protect the substrate 20 to which the LEDs 21 are mounted from external dust and moisture.

The light penetration cover 70 may be transparent, and may be semitransparent or specific-colored according to a purpose of the lighting apparatus.

As described above in detail, since arbitrary light distribution patterns can be made according to a curvature of the reflection portion 30, an arrangement of the LEDs 21, an orientation angle of the LEDs 21, an inclined degree of the support panel 10, and existence of the reflection plate 60, the present disclosure can be applied to application fields of the lighting apparatus while using the same structure.

The present disclosure is not limited to the above embodiments, and it is obvious to those skilled in the art to which the present disclosure pertains that various modifications and changes may be implemented without departing from the technical spirit of the present disclosure.

Figure 10:
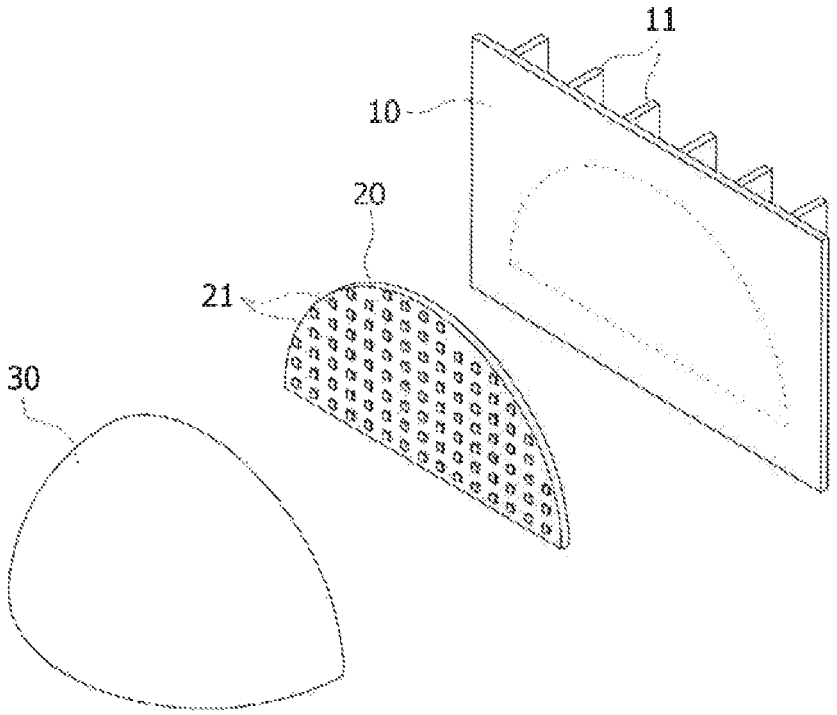

For example, FIG. 10 is an exploded perspective view showing an LED lighting apparatus capable of adjusting light distribution according to another embodiment of the present disclosure, and the support panel 10 may not have a shape of a semicircular disc or a shape of a circular disc but may have a shape of a rectangular plate.

Figure 11:
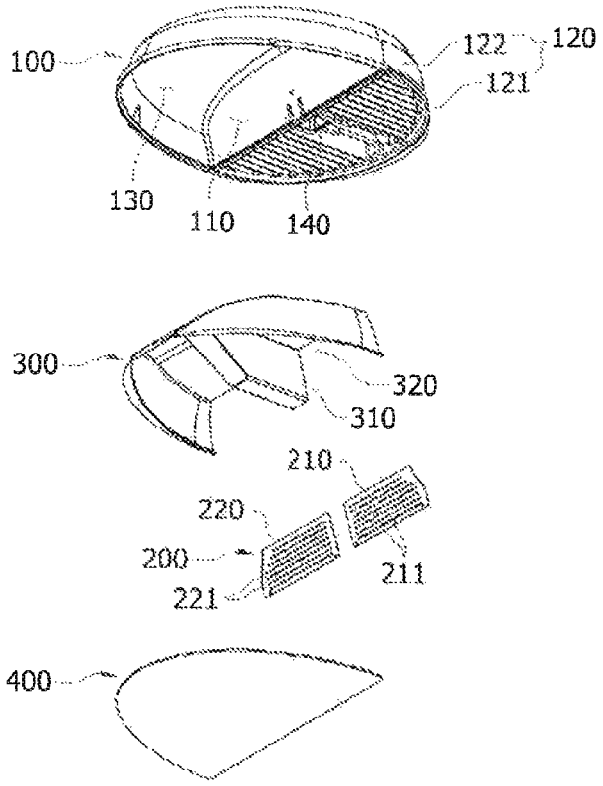
FIG. 11 is an exploded perspective view showing an LED lighting apparatus capable of adjusting light distribution according to another embodiment of the present disclosure.
Figure 12:
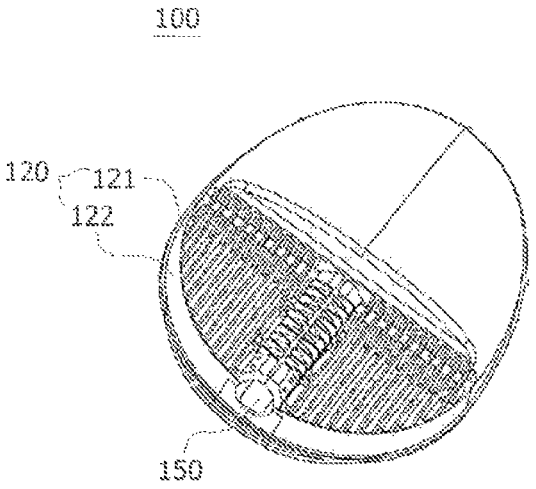
FIG. 12 illustrates a detailed configuration of a housing shown in FIG. 11.

FIG. 11 is an exploded perspective view showing an LED lighting apparatus capable of adjusting light distribution according to another embodiment of the present disclosure, and FIG. 12 is a perspective view showing a housing shown in FIG. 11 in detail.

Referring to FIGS. 11 and 12, the LED lighting apparatus capable of adjusting light distribution according to another embodiment of the present disclosure includes a housing 100 providing a support panel providing a support surface 110 in which substrates 210 and 220 to which a plurality of LEDs 211 and 221 are mounted are installed, a heat dissipation portion 120 including a plurality of heat dissipation fins 121 vertically provided on a rear surface of the support surface 110 and a curved cover 130 at an upper side of the support surface 110 being integrally provided in the housing 100, and a light distribution pattern portion 300 located within a space defined by the support surface 110 of the housing 100 and the cover 130, for reflecting light emitted from the LEDs 210 of the substrate 200 installed in the support surface 110 to form a light distribution pattern.

Hereinafter, a configuration and an operation of the LED lighting apparatus capable of adjusting light distribution according to another embodiment of the present disclosure as configured above will be described in more detail.

First, the housing 100 has a semispherical structure, and has the support panel providing the support surface 110 not parallel with the ground at a central side thereof. The heat dissipation portion 120 is provided at the support panel at a rear side of the support surface 110, and the cover 130 is provided at a front side of the support surface 110.

Further, a column of a street light or another support frame is inserted into a central side of the heat dissipation portion 120, and a coupling hole 150 for coupling and fixing the present disclosure to the column or the support frame is provided.

The heat dissipation portion 120 is provided with the plurality of heat dissipation fins 121 arranged to be perpendicular to the ground, and has a penetrated structure in which air flows pass between the heat dissipation fins 121 to improve a heat dissipation effect.

Although a heat dissipation fin support 122 is provided at an outer side of the heat dissipation fins 121 in a band shape to connect central portions of the heat dissipation fins 121, the heat dissipation fin support 122 may be omitted.

The support surface 110 of the housing 100 is a surface not parallel with the ground, and is preferably a surface provided to be perpendicular with the ground. The curved cover 130 having a space therein is provided at a front side of the support surface 110. Since the cover 130 is curved, it is difficult to process an inner surface of the cover 130 as a reflection surface and to change a shape of the cover 130. Thus, it is difficult to provide various light distribution patterns.

Thus, in order to easily change the light distribution pattern, the light distribution pattern portion 300 is installed within the space defined by the cover 130 and the support surface 110.

The light distribution pattern portion 300 is manufactured such that a shape thereof is variously changed, and shows different light distribution patterns according to the shape thereof. As shown in FIG. 11, the light distribution pattern portion 300 includes a division portion 310 in contact with a boundary between the two substrates 210 and 220, for dividing light of the LEDs 211 and 221 provided in the substrates 210 and 220, respectively, and a reflection surface 320 for reflecting the light of the LEDs 211 and 221 to the ground.

Figure 13:
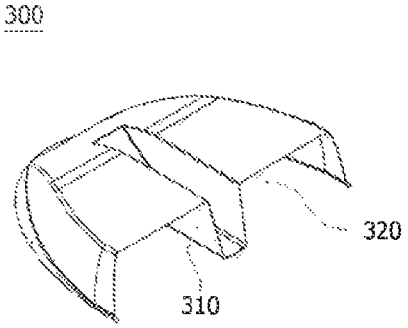
FIG. 13 illustrates a detailed configuration of a light distribution pattern portion shown in FIG. 11.
Figure 14:
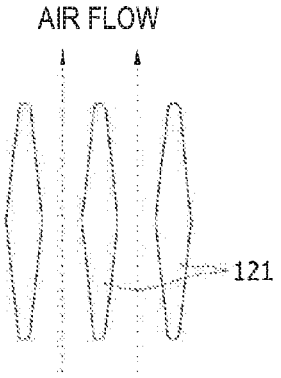
FIG. 14 illustrates a sectional configuration of a heat dissipation fin shown in FIG. 11.

FIG. 13 illustrates a detailed configuration of a light distribution pattern portion.

Referring to FIG. 13, the light distribution pattern portion 300 is provided with the reflection surface 320 received within the cover 130, for changing the light distribution pattern according to a shape of the light distribution pattern portion 300, and the division portion 310 for dividing the reflection portion into a left side and a right side.

The division portion 310 and the reflection surface 320 are plate structures made of a metallic material. Although the division portion 310 is configured by a predetermined width in the drawing, the division portion 310 may be a metallic plate member extending downward from the reflection surface 320 or may be omitted.

In this way, since the light distribution pattern portion 300 has a plate-shaped structure, various light distribution patterns may be provided without changing a shape of the cover 130 of the housing 100 while preventing an increase in weight.

The reflection surface 320 may be a combination of planes of which inclinations are different from each other or a curved surface, and may be properly combined according to a desired light distribution pattern.

There may be a difference between a light distribution pattern required when the LED lighting apparatus capable of adjusting light distribution according to the present disclosure is employed as a street light and a light distribution pattern required when the LED lighting apparatus capable of adjusting light distribution according to the present disclosure is employed as a security light or an indoor light, and light distribution patterns which match purpose of each of the lighting apparatuses may be provided by differently applying shapes of the light distribution pattern portion 300 without changing the other structures.

As described above, the housing 100 has an integrated structure, and heat generated in the LEDs 211 and 221 provided in the substrates 210 and 220 is dissipated by the heat dissipation portion 120 provided at a rear side of the support surface 110. Although it is illustrated and described in FIG. 11 that the two substrates 210 and 220 are divided, an integrated singular substrate may be employed, or substrates divided into three or more parts may be employed.

In order to integrally form the housing 100, the heat dissipation fins 121 of the heat dissipation portion 120 has a structure in which a width of a cross section of a central portion thereof is wider than upper and lower ends thereof. The reason for this is to easily perform a molding process for integrally forming the housing 100.

A space is provided between the heat dissipation fins 121 so that an upward air flow caused by a temperature difference generated when lights are switched on smoothly passes through the space between the heat dissipation fins 121, thereby improving a heat dissipation effect.

As described above, the coupling hole 150 is formed at a rear central side of the heat dissipation portion 120 including the heat dissipation fins 121, and a wire connection space 140 communicating with the coupling hole 150 is provided at a bottom surface of the heat dissipation portion 120.

The wire connection space 140 corresponds to a space for easily installing the lighting apparatus according to an embodiment of the present disclosure, and provides a space for connecting a wire connected to the substrates 210 and 220 to a wire provided at a support member such as a column.

When the present disclosure is applied to a street light, an installation is performed at a high place. When one worker couples the housing to a column and then connects wires of the column and wires of the substrates 210 and 220 to each other in the wire connection space 140, the installation is completed. Thus, the installation can be easily performed and the number of workers can be reduced.

In a state where the light distribution pattern portion 300 is inserted into the cover 130, an opened portion at a bottom side of the cover 130 can prevent foreign substances from entering the lighting apparatus by a cover 400.

Figure 15:
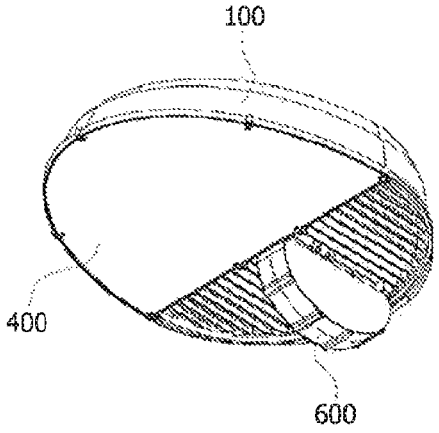
FIG. 15 is a perspective view of a bottom surface of an LED lighting apparatus capable of adjusting light distribution according to another embodiment of the present disclosure.

FIG. 15 illustrates a configuration of an LED lighting apparatus capable of adjusting light distribution according to another embodiment of the present disclosure.

Referring to FIG. 15, the LED lighting apparatus capable of adjusting light distribution according to another embodiment of the present disclosure further includes a receiving portion 600 coupled to a bottom side of the wire connection space 140 described with reference to FIG. 11.

The receiving portion 600 has a space therein, and a camera, a wireless communication repeater, an antenna, or the like may be installed in the space according to necessity.

The function of the lighting apparatus may be expanded to various fields by adding the receiving portion 600.

The present disclosure is not limited thereto, and it is obvious to those skilled in the art to which the present disclosure pertains that various modifications and changes may be implemented without departing from the technical spirit of the present disclosure.

The present disclosure has various light distribution patterns by changing a reflection plate in a state where an arrangement of LEDs is fixed. A housing for fixing the LEDs can be produced by a large amount in a same form so that industrial applicability thereof is excellent.

The invention claimed is:

1. An LED lighting apparatus capable of adjusting light distribution, the apparatus comprising:

a support panel that has a plurality of heat dissipation fins on a rear surface thereof and provides a support surface;

a substrate coupled to the support surface of the support panel, a plurality of LEDs being mounted to the substrate; and a reflection surface located on a front surface of the substrate, that forms a light distribution pattern on the ground by reflecting light emitted from the plurality of LEDs, wherein the heat dissipation fins and the support panel that provides the support surface are integrally provided, and the reflection surface is provided at an inner surface of a light distribution pattern portion provided to be separable from the support surface, and wherein the light distribution pattern portion comprises a division portion that divides the LEDs of the substrate into a left side and a right side with respect to a center of the reflection surface and extends toward a lower side.

2. The apparatus as claimed in claim 1, wherein the substrate is divided into a plurality of parts, and the LEDs are selectively mounted to the divided substrates.

3. The apparatus as claimed in claim 2, wherein the support surface of the support panel further comprises a plurality of inclined support portions, and the divided substrates are fixed to the plurality of inclined support portions, respectively.

4. The apparatus as claimed in claim 1, wherein the reflection surface corresponds to an inner surface of the reflection portion obtained by dividing a sphere with respect to a horizontal center and a vertical center.

5. The apparatus as claimed in claim 4, wherein the sphere has a vertical diameter and a horizontal diameter, which are equal to each other.

6. The apparatus as claimed in claim 4, wherein the sphere has a vertical diameter and a horizontal diameter, which are different from each other.

7. The apparatus as claimed in claim 1, further comprising a reflection plate provided at a lower portion of the substrate, that reflects light reflected from the reflection portion.

8. The apparatus as claimed in claim 7, further comprising a light penetration cover located at a front surface of the reflection plate, that covers a lower space of the reflection portion.

9. The apparatus as claimed in claim 8, wherein the light penetration cover is transparent, semitransparent, or colored.

10. The apparatus as claimed in claim 2, wherein the divided substrates are installed to be inclined by a predetermined angle with respect the support surface of the support panel.

11. The apparatus as claimed in claim 1, further comprising a housing that supports the support panel at a rear side of the support panel and comprises a hinge to adjust an angle.

12. The apparatus as claimed in claim 11, wherein the housing comprises a plurality of coupling protrusions, and an end of each of the coupling protrusions is coupled to the support panel so as to fix the support panel while being spaced apart from the heat dissipation fins of the support panel.

13. The apparatus as claimed in claim 1, wherein a cover that receives the light distribution pattern portion at a front side of the support surface, and the support panel that provides the support surface are integrally provided.

14. The apparatus as claimed in claim 1, wherein a coupling hole having a support inserted in and fixed to the coupling hole is provided at a rear side of a heat dissipation portion comprising the heat dissipation fins.

15. The apparatus as claimed in claim 14, wherein a wire connection space communicating with the coupling hole is provided at a bottom surface of the heat dissipation portion.

16. The apparatus as claimed in claim 15, further comprising a receiving portion fixed at a lower side of the wire connection space, that provides a space that can selectively receive a wireless communication repeater, an antenna, a camera, or the like.

17. The apparatus as claimed in claim 14, wherein a width of a central side of each of the heat dissipation fins of the heat dissipation portion is wider than a width of upper and lower ends of each of the heat dissipation fins.

18. An LED lighting apparatus capable of adjusting light distribution, the apparatus comprising:

a support panel that has a plurality of heat dissipation fins on a rear surface thereof and provides a support surface;

a substrate coupled to the support surface of the support panel, a plurality of LEDs being mounted to the substrate; and a reflection surface located on a front surface of the substrate, that forms a light distribution pattern on the ground by reflecting light emitted from the plurality of LEDs wherein the heat dissipation fins and the support panel that provides the support surface are integrally provided, and the reflection surface is provided at an inner surface of a light distribution pattern portion provided to be separable from the support surface, and wherein a coupling hole having a support inserted in and fixed to the coupling hole is provided at a rear side of a heat dissipation portion comprising the heat dissipation fins.

19. The apparatus as claimed in claim 18, wherein a cover that receives the light distribution pattern portion at a front side of the support surface, and the support panel that provides the support surface are integrally provided.

20. The apparatus as claimed in claim 18, wherein a wire connection space communicating with the coupling hole is provided at a bottom surface of the heat dissipation portion.

21. The apparatus as claimed in claim 20, further comprising a receiving portion fixed at a lower side of the wire connection space, that provides a space that can selectively receive a wireless communication repeater, an antenna, a camera, or the like.

22. The apparatus as claimed in claim 18, wherein a width of a central side of each of the heat dissipation fins of the heat dissipation portion is wider than a width of upper and lower ends of each of the heat dissipation fins.

* * * * *